US010807679B2

(12) United States Patent
Kang

(10) Patent No.: US 10,807,679 B2
(45) Date of Patent: Oct. 20, 2020

(54) EMERGENCY ESCAPE APPARATUS FOR A SHIP

(71) Applicant: Seungho Kang, Barrigada, GU (US)

(72) Inventor: Seungho Kang, Barrigada, GU (US)

( * ) Notice: Subject to any disclaimer, the term of this patent is extended or adjusted under 35 U.S.C. 154(b) by 126 days.

(21) Appl. No.: 16/223,190

(22) Filed: Dec. 18, 2018

(65) Prior Publication Data

US 2019/0337594 A1 Nov. 7, 2019

(30) Foreign Application Priority Data

May 3, 2018 (KR) ..... 10-2018-0051372

(51) Int. Cl.
*B63B 19/28* (2006.01)
*B63B 19/00* (2006.01)

(52) U.S. Cl.
CPC ..... *B63B 19/28* (2013.01); *B63B 19/00* (2013.01); *B63B 2019/0053* (2013.01); *E05Y 2900/514* (2013.01)

(58) Field of Classification Search
CPC ..... E02B 7/40; E06B 2009/007; B63B 19/28; B63B 19/00; B63B 2019/0053; B63B 19/12; E05Y 2900/514
See application file for complete search history.

(56) References Cited

U.S. PATENT DOCUMENTS 2,631,032 A * 3/1953 Denker ..... B63B 19/14 49/278
5,255,479 A * 10/1993 Shepherd ..... A62B 3/00 49/449
5,577,863 A * 11/1996 Nottle ..... E02B 7/205 405/100
6,287,050 B1 * 9/2001 Montgomery ..... E02B 7/40 405/92
6,467,998 B1 * 10/2002 Timms ..... E02B 7/205 405/104
6,485,231 B2 * 11/2002 Montgomery ..... E02B 7/40 405/92
6,540,288 B1 * 4/2003 Tobin ..... B60J 7/1642 296/216.02
6,692,187 B2 * 2/2004 Sprengle, Sr. ..... E02B 7/40 405/92
6,779,947 B1 * 8/2004 Buchanan ..... E02B 7/40 405/100
7,926,539 B1 * 4/2011 Hurst ..... E05B 51/023 160/104

(Continued)

FOREIGN PATENT DOCUMENTS

KR 10-0540586 B1 1/2006
KR 10-1744384 B1 6/2017

*Primary Examiner* — Justin B Rephann

(74) *Attorney, Agent, or Firm* — Fish & Richardson P.C.

(57) ABSTRACT

An escape apparatus for a vessel includes a support frame that is configured to be installed at the vessel and that defines defining an exit opening, an escape door located at an inner side of the exit opening and configured to open and close the exit opening, where the escape door defines an accommodation space, a floater located in the accommodation space of the escape door and configured to be raised relative to the support frame, and an unlocking device configured to, based on being pushed by the raised floater, release coupling between the escape door and the support frame.

15 Claims, 7 Drawing Sheets

(56) References Cited

U.S. PATENT DOCUMENTS

| | | | | |
|---|---|---|---|---|
| 8,308,396 | B2 * | 11/2012 | Shook | E04B 1/7076 405/100 |
| 8,328,137 | B2 * | 12/2012 | Sutthoff | B64C 1/1446 244/118.5 |
| 8,375,664 | B2 * | 2/2013 | Gower, Sr. | E04B 1/7076 52/169.5 |
| 9,551,153 | B2 * | 1/2017 | Anderson, Jr. | B01D 17/0214 |
| 9,624,637 | B2 * | 4/2017 | Anderson, Jr. | E04B 1/7076 |
| 10,301,870 | B2 * | 5/2019 | Kelly | E04B 1/7076 |
| 2002/0021941 | A1 * | 2/2002 | Montgomery | E04B 1/7076 405/100 |
| 2003/0082008 | A1 * | 5/2003 | Sprengle, Sr. | F24F 11/76 405/87 |

* cited by examiner

EMERGENCY ESCAPE APPARATUS FOR A SHIP

CROSS-REFERENCE RELATED APPLICATIONS

This application claims the benefit of an earlier filing date and priority to Korean Application No. 10-2018-0051372, filed on May 3, 2018, the contents of which are incorporated by reference herein in their entirety.

TECHNICAL FIELD

The present disclosure relates to an emergency escape apparatus for a ship and, more specifically, a latching device configured to be released by buoyancy and an escape door configured to detach from a support frame and to enable passengers to easily escape from a ship.

BACKGROUND

A vessel may transport freight or passengers overseas. In some cases, a vessel such as a ship may sink, for example, when it crashes into reef or collides with another ship, or due to overloading or other structural defects of the ship itself.

A ship may include various spaces structurally connected together, for example, an engine room, crew room, cabin, and other spaces. In some cases when the ship is flooded, water may flow through passages into the cabin. In some cases, the passengers inside the cabin may be in danger of drowning if the cabin door does not open up properly.

SUMMARY

The present disclosure provides an emergency escape apparatus of ship that enables passengers onboard to escape quickly from a ship.

According to one aspect of the subject matter described in this application, an escape apparatus for a vessel includes a support frame configured to be installed at the vessel, where the support frame defines an exit opening, an escape door located at an inner side of the exit opening and configured to open and close the exit opening, where the escape door defines an accommodation space, a floater located in the accommodation space of the escape door and configured to be raised relative to the support frame, and an unlocking device configured to, based on being pushed by the raised floater, release coupling between the escape door and the support frame.

Implementations according to this aspect may include one or more of the following features. For example, the unlocking device comprises a first unlocking part located at an upper side of the floater. The first unlocking part may include: a first pushing rod that extends in an upward direction from the upper side of the floater and that is configured to move upward based on being pushed by the upper side of the floater; a first latching rod configured to move downward to be released from the support frame based on the first pushing rod moving upward; a first link assembly that connects the first pushing rod and the first latching rod to each other; and a first spring that connects the escape door and the first link assembly to each other.

In some implementations, the unlocking device further may include a second unlocking part located at a lower side of the floater. The second unlocking part may include: a second pushing rod that extends in a downward direction from the lower side of the floater and that is configured to move downward based on being pushed by the lower side of the floater; a second latching rod configured to move upward to be released from the support frame based on the second pushing rod moving downward; a second link assembly that connects the second pushing rod and the second latching rod to each other; and a second spring that connects the escape door and the second link assembly to each other.

In some implementations, the first latching rod may include a pair of first latching rods that are located at a first lateral side and a second lateral side with respect to the first pushing rod, respectively, the pair of first latching rods being configured to move downward together based on the first pushing rod moving upward. The second latching rod may include a pair of second latching rods that are located at the first lateral side of the second pushing rod and the second lateral side with respect to the second pushing rod, the pair of second latching rods being configured to move upward together based on the second pushing rod moving downward.

In some examples, the first link assembly may include: a pair of first pushing links, each of the pair of first pushing links having a first end connected to an upper end of the first pushing rod; a pair of first connection links, each of the pair of first connection links being configured to rotate about a first hinge axis positioned at a rear cover of the escape door, and having a first end connected to a second end of one of the pair of first pushing links; and a pair of first latching links, each of the pair of first latching links having a first end connected to the first end of one of the pair of first connection links, and a second end connected to a lower end of one of the pair of first latching rods. The second link assembly may include: a pair of second pushing links, each of the pair of second pushing links having a first end connected to a lower end of the second pushing rod; a pair of second connection links, each of the pair of second connection links being configured to rotate about a second hinge axis positioned at the rear cover of the escape door, and having a first end connected to a second end of one of the pair of second pushing links; and a pair of second latching links, each of the pair of second latching links having a first end connected to the first end of one of the pair of second connection links, and a second end connected to an upper end of one of the pair of second latching rods.

In some implementations, the escape apparatus may further include a guide bracket that is located at the rear cover of the escape door and that defines a guide hole configured to guide movement of at least one of the first pushing rod, the second pushing rod, the first latching rod, or the second latching rod.

In some implementations, the escape apparatus may further include a plurality of guide rollers that are located in the accommodation space at a position between an outer surface of the floater and an inner surface of the escape door facing the outer surface of the floater, where the plurality of guide rollers are configured to guide movement of the floater toward at least one of an upper side of the support frame or a lower side of the support frame.

In some examples, the escape door may include a front cover that is configured to face an interior of the vessel, where the front cover includes a handle located at a front surface of the front cover and an access part that allows a user to access the handle to operate the floater. In some examples, the access part is configured to cover the handle from the interior of the ship, where the floater is configured to be raised based on the user passing through the access part and lifting the handle relative to the support frame. For example, the user may break the access part to access the handle.

In some implementations, the escape door may define an opening that is positioned at at least one of a lower portion of the escape door or an upper portion of the escape door, that communicates with the accommodation space, and that allows water to enter the accommodation space, the floater is configured to be raised in the accommodation space by buoyancy of the floater in water. In some examples, the escape door may include a front cover that is configured to face an interior of the ship and a rear cover that faces an outside of the ship and that is coupled to the front cover, where the accommodation space is defined between the front cover and the rear cover, and at least one of the front cover or the rear cover defines an opening that allows water to enter the accommodation space.

In some examples, the upper side of the floater may be configured to contact a lower end of the first pushing rod based on the floater moving upward by buoyancy of the floater. In some examples, the rear cover may include at least one protrusion that extends from an inner surface of the rear cover toward the front cover and that is configured to limit deformation of the front cover toward the rear cover. In some examples, the first link assembly may be configured to contact the protrusion based on the first pushing rod moving upward by the upper side of the floater. In some examples, the floater may be located vertically between a lower end of the first pushing rod and an upper end of the second pushing rod. In some examples, the guide bracket may include a plurality of guide brackets coupled to the first spring and to the second spring, respectively.

DETAILED DESCRIPTION

Figure 1:
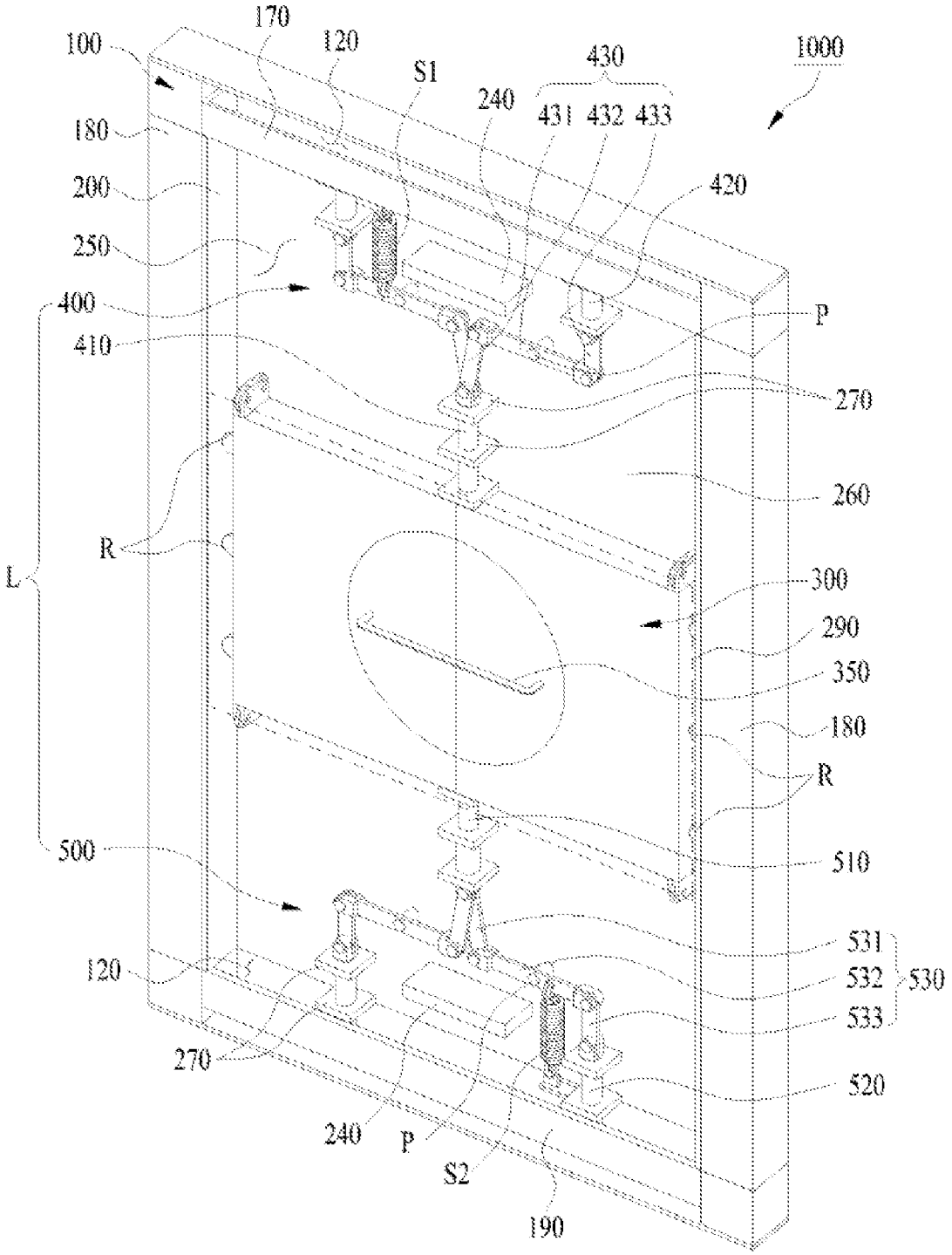
FIG. 1 is a perspective view illustrating an example emergency escape apparatus of ship.
Figure 2:
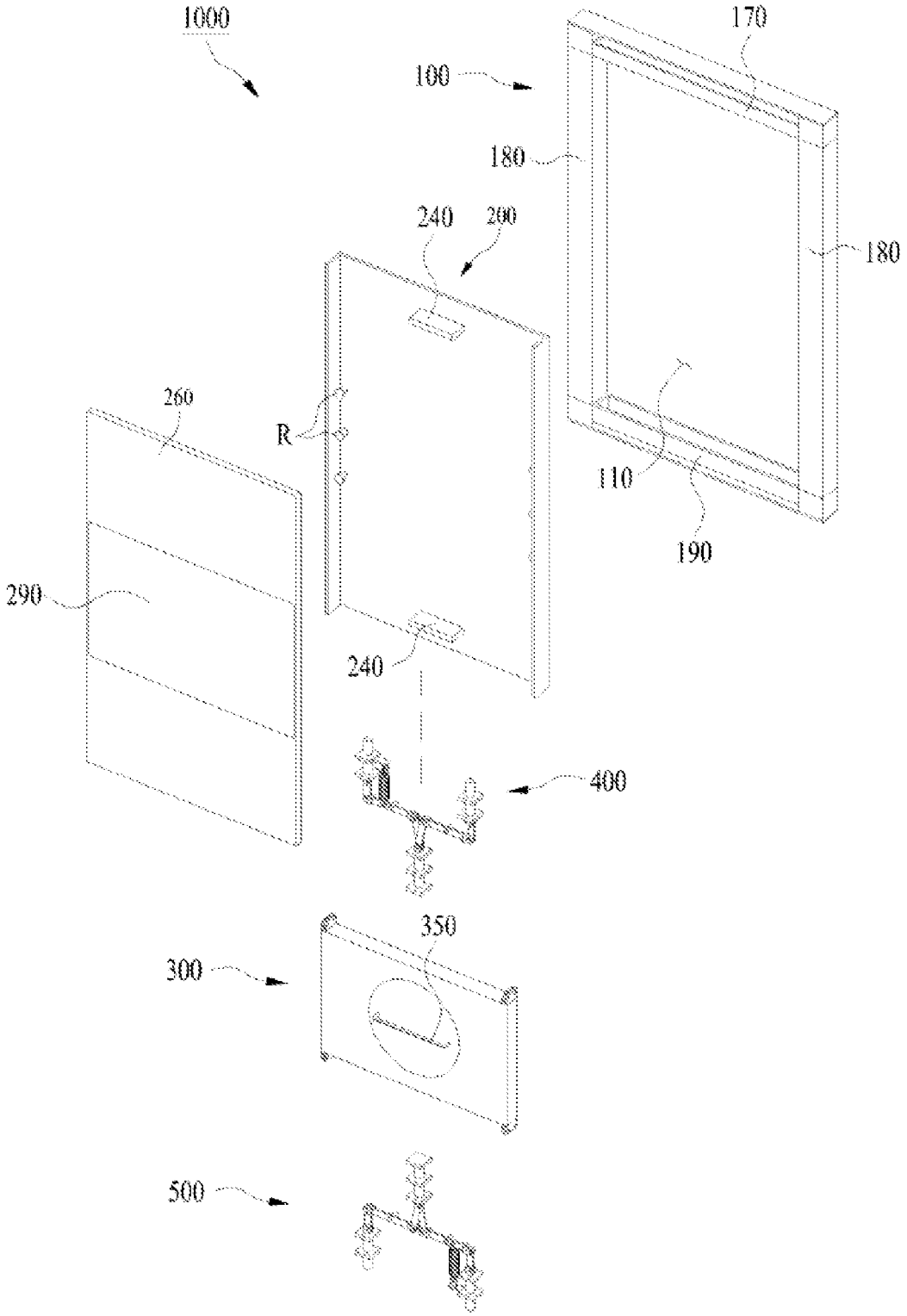
FIG. 2 is a dissembled perspective view of FIG. 1.

Hereinafter, one or more example implementations are described with reference to FIGS. 1 to 7.

An emergency escape apparatus 1000, as shown in FIGS. 1 to 7, includes a support frame 100 located inside the exit opening 110; an escape door 200 that is configured to open and close the exit opening 110, that is detachably installed at an inner side of the exit opening 110, and that defines an accommodation space 250; a floater 300 located in the accommodation space 250 of the escape door 200; and an unlocking device L located in the accommodation space 250 and configured to decouple coupling between the escape door 200 and the support frame 100 based on being pushed by the floater 300 that is raised.

For example, when the ship is submerged and water flows in, the floater 300 may ascend due to buoyancy, and then release coupling between the escape door 200 and support frame 100 through the connected unlocking device L on the floater 300.

In some implementations, the escape door 200 includes a space to accommodate a floater 300 and unlocking device L.

In some examples, the escape door 200 may provide an accommodation space 250 and form a box like structure with a rectangular cross-sectional shape.

In this case, the upper and lower ends of the escape door 200 are opened, and through it locking and releasing action motion between unlocking device L and support frame 100 is possible.

The unlocking device L includes the first unlocking part 400 placed on the support portion of the floater 300.

More specifically, the first unlocking part 400 includes a first pushing rod 410 that extends in an upward direction from an upper part of the floater 300, a first latching rod 420 that descends in accordance with first pushing rod 410, and a first link assembly 430 that mechanically connects the first pushing rod 410 with the first latching rod 420. The first unlocking part 400 may further include a first spring S1 that elastically connects the first link assembly 430 and the escape door 200.

In some examples, the first latching rod 420 may be coupled to an upper latching part 170 of the support frame 100 and held in a state inserted into latching groove 120 defined at the latching part 170. When the escape door 200 is opened, the first latching rod 420 is released from the latching groove 120.

In some implementations, a twisted spring may be embedded to connect the side 180 of the support frame 100 to the latching part 170. In order for the latching part 170 of the support frame 100 is configured to move the hinge on the side of the support frame 100, so the escape door 200 inserted in the latching groove 120 rotates and is restored to its original position.

The first latching rod 420 includes a pair of left and right latching rods in accordance with the first pushing rod. The first latching rod 420 of a pair can be lowered down simultaneously.

The escape door 200 with respect to the support frame 100 turns it into a more stable foundation accordingly.

The first link assembly 430 connects the first pushing rod 410 and two first latching rods 420, respectively, and relays movement (e.g., an upward movement or a downward movement) of the first pushing rod 410 to the first latching rods 420.

More specifically, the first link assembly 430 includes: a pair of first pushing links 431, each of which has a first end hingedly connected to the upper end of the first pushing rod 410; a pair of first connection links 432 configured to rotate about a hinge point (P) that is installed on a rear cover of the escape door 200, where each of the first connection links 432 has one end hingedly coupled to a second end of the first pushing links 431; and a pair of first latching link 433, each of which has a first end hingedly connected to the other end of the first connection links 432 and a second end hingedly connected to a lower end of each of the first latching rods 420.

In case the first spring S1 doesn't submerge because the firsts connection link 432 and first connection link 432 is connected, and if buoyant doesn't operate, the floater is positioned into the upper and lower center of escape door 200 so the escape door 200 completely latches on the support frame 100 by buoyancy.

As depicted, the first unlocking part 400 installed on the upper portion of the floater 300 alone enables opening and detaching of escape door 200 against the support frame 100.

However, the unlocking device L may further include a second unlocking part 500 installed on a lower portion of the floater 300 and operate even when the ship is turned upside down.

The second unlocking part 500 may include: a second pushing rod 510 that extends from a lower part of floater 300 downward in one direction; a second latching rod 520 configured to be raised based on a descending movement of the second pushing rod 510; a second link assembly 530 that mechanically connects the second pushing rod 510 and the second latching rod 520; and a second spring S2 that elastically connects the escape door 200 and the second link assembly 530 to each other.

In a normal state, the second latching rod 520 may be placed on the support frame 100 and inserted into the latching groove 120 defined at a lower latching part 190 of the support frame 100. When the escape door 200 is opened, the second latching rod 520 may be released from the latching groove 120.

In some implementations, the lower latching part 190 of the support frame 100 may be configured to hingedly move with respect to a side 180 of the support frame 100. In some cases, in order for the escape door 200 to rotate and restore its position, a twisted spring may be embedded to connect the support frame 100 on the side 180 of support frame 100.

The second latching rod 520 includes a pair of left and right latching rods. The pair of second latching rods 520 are recommended to be raised in line with the descent of the second pushing rod 510 simultaneously.

The escape door 200 with respect to the support frame 100 turns it into a stable foundation accordingly.

The second link assembly 530 is connected to the second pushing rod 510 and a pair of second latching rods 520, respectively, and the second pushing rod 510 and the second latching rods 520 can to move up and down to connect with each other. In some examples, the second link assembly 530 includes: a pair of second pushing links 531, each of which has a first end hingedly connected to a lower end of the second pushing rod 510; a pair of second connection link 532 configured to rotate about a hinge point P installed on the rear cover of the escape door 200, where each of the second connection links 532 has one end hingedly coupled to a second end of the second pushing links 531; and a pair of second latching link 533, each of which has a first end hingedly connected to the other end of the second connection links 532 and a second end hingedly connected to an upper end of each of the second latching rods 520.

The second spring S2 connects the second connection link 532 and the escape door 200, and applies restoring force to the floater 300 when buoyancy force is not apply to the floater 300 (e.g., when the floater 300 is not submerged in water) so that the floater 300 is positioned at a center position between the upper and lower sides of the escape door 200 and that the escape door 200 latches to the support frame 100.

The placement of the emergency escape apparatus 1000 is easy to detach regardless of its installation direction, and the unlocking function by buoyancy and makes it much easier to place, even if the ship turns over, the escape door can form an exit easily against the support frame 100.

In some implementations, multiple guide rollers R, which are located between the inner left and right side of escape door 200, may smoothly guide movement of floater 300.

In some examples, a detachable access part 290 is installed to a front cover 260 of the escape door 200 that faces an interior of the ship (e.g., a cabin of the ship), and a turning handle 350 may be located at the front surface of floater 300.

In an urgent situation, a user may not necessarily wait until buoyancy is applied to the floater 300, but the access part 290 may be hit to detach the escape door 200 in a speedy manner by pushing up the handle to separate the escape door 200 from support frame 100. The access part 290 may cover the handle 350 from the interior of the ship to limit an unintentional use of the handle 350 in a normal situation.

In some implementations, the emergency escape apparatus 1000 may include a protective protrusion 240 installed on a rear cover of the escape door 200 at a position inside of the first link assembly 430 and the second link assembly 530, to protect a potential damage of the first link assembly 430 or the second link assembly 530, for example, in case when the front cover 260 is seriously damaged or contacts the first link assembly 430 and the second link assembly 530.

In some implementations, the escape door 200 may include a plurality of guide brackets 270 configured guide movement the first pushing rod 410, the second pushing rod 510, the first latching rod 420, and the second latching rod 520, where the guide brackets 270 each may define a guide hole that receives one of the first pushing rod 410, the second pushing rod 510, the first latching rod 420, and the second latching rod 520. The guide brackets 270 may be installed on a rear cover of the escape door 200 that faces the accommodation space.

In some cases, the emergency escape apparatus 1000 may be a part of a surrounding wall of a cabin or a door itself of the cabin.

Hereinafter, an example operation of the emergency escape apparatus 1000 with reference to FIGS. 2 to 7 will be described.

Figure 3:
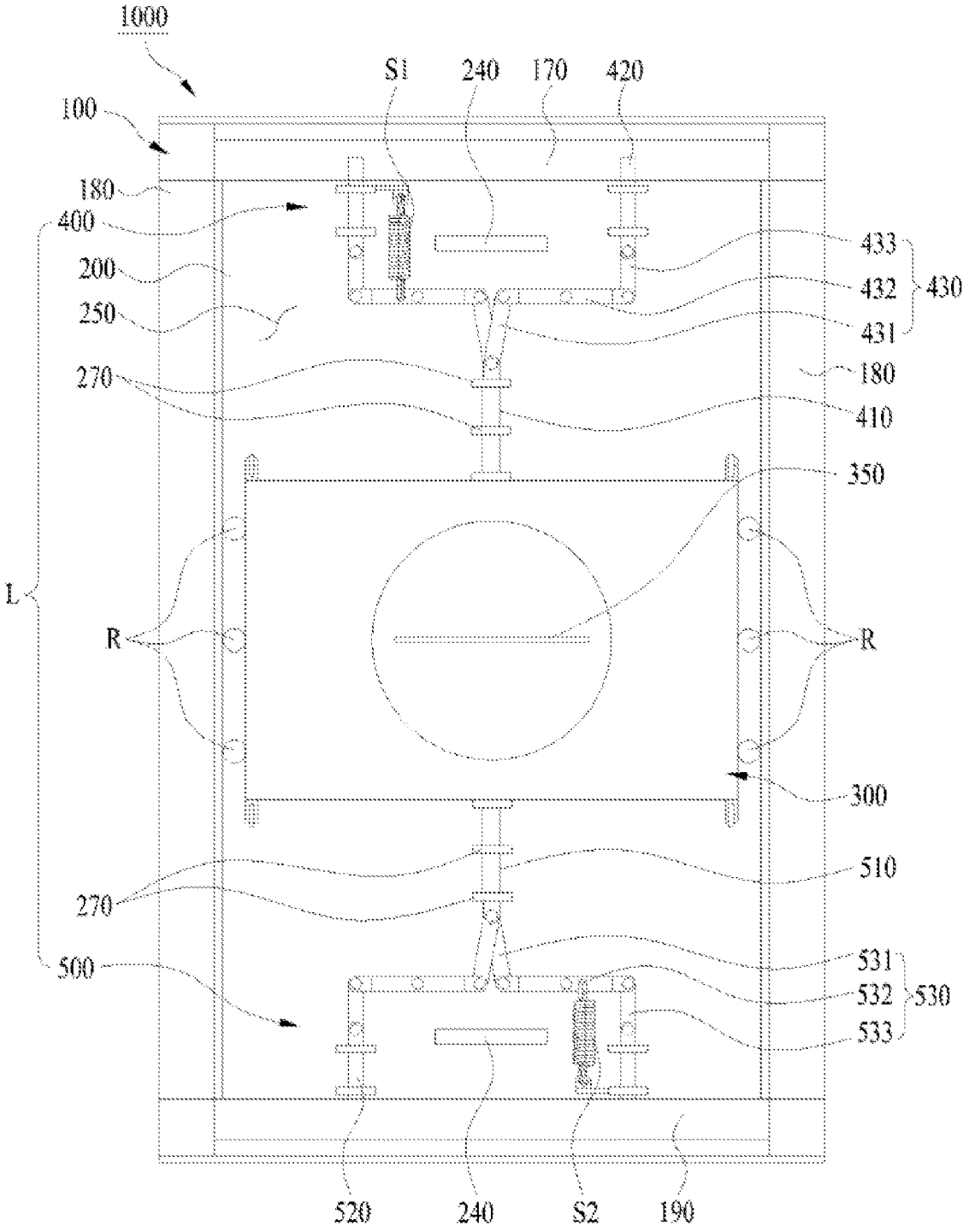
FIG. 3 is a front view illustrating an example emergency escape apparatus of ship.
Figure 5:
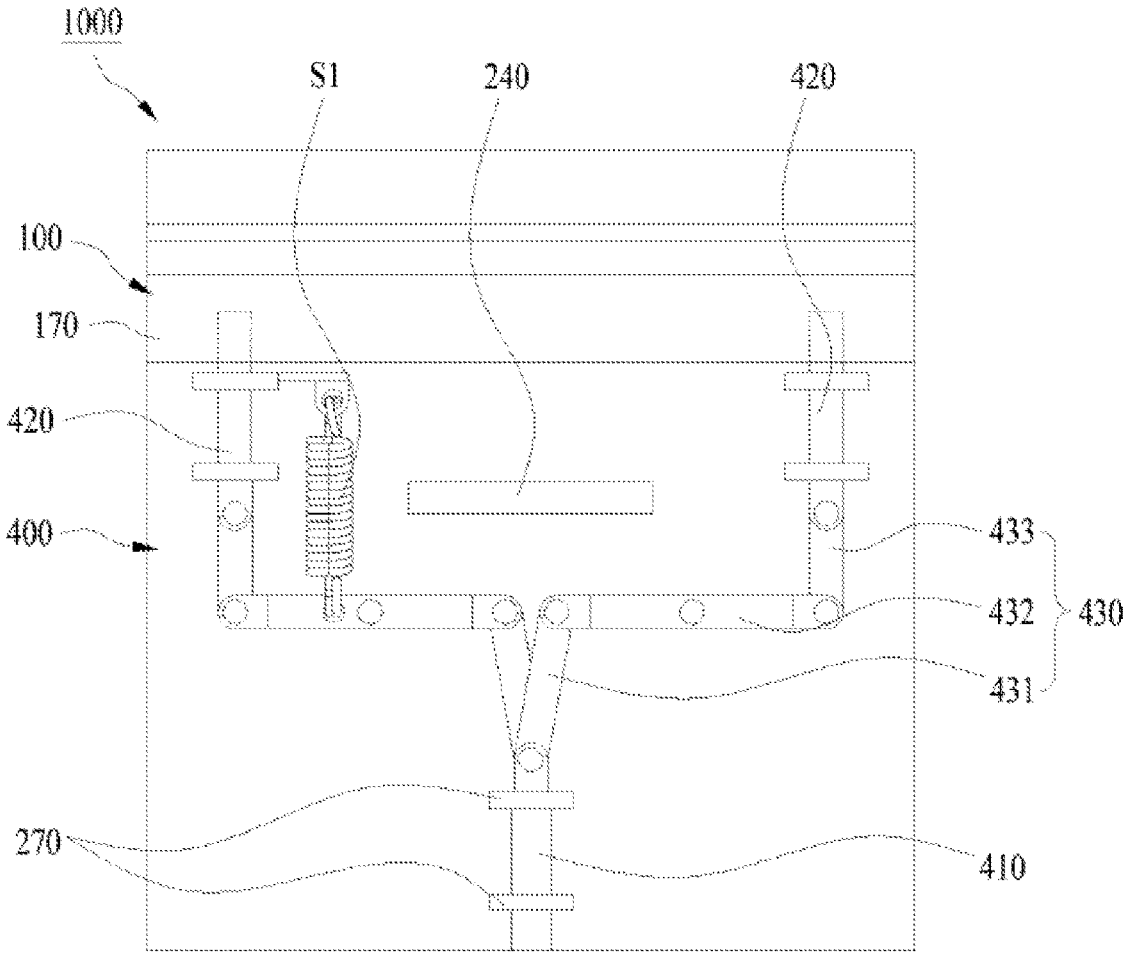
FIG. 5 is an enlarged view of front view illustrating an example emergency escape apparatus of ship.

In some implementations, the floater 300 may be normally positioned in the center, without taking sides lopsidedly on either side as shown in FIG. 3 and FIG. 5.

Thus, each of the first latching rods 420 stays connected to the pair of first latching links 433 by the tension spring S on the first link assembly 430, and latches on the latching groove 120 of latching part 170 of support frame 100. In this coupled state, the escape door 200 may not be detached from the support frame 100 in a front-back direction.

In a state in which the first unlocking part 400 installed in the escape door 200 is latched to the support frame 100, the escape door 200 may not detach from the support frame 100.

Figure 4:
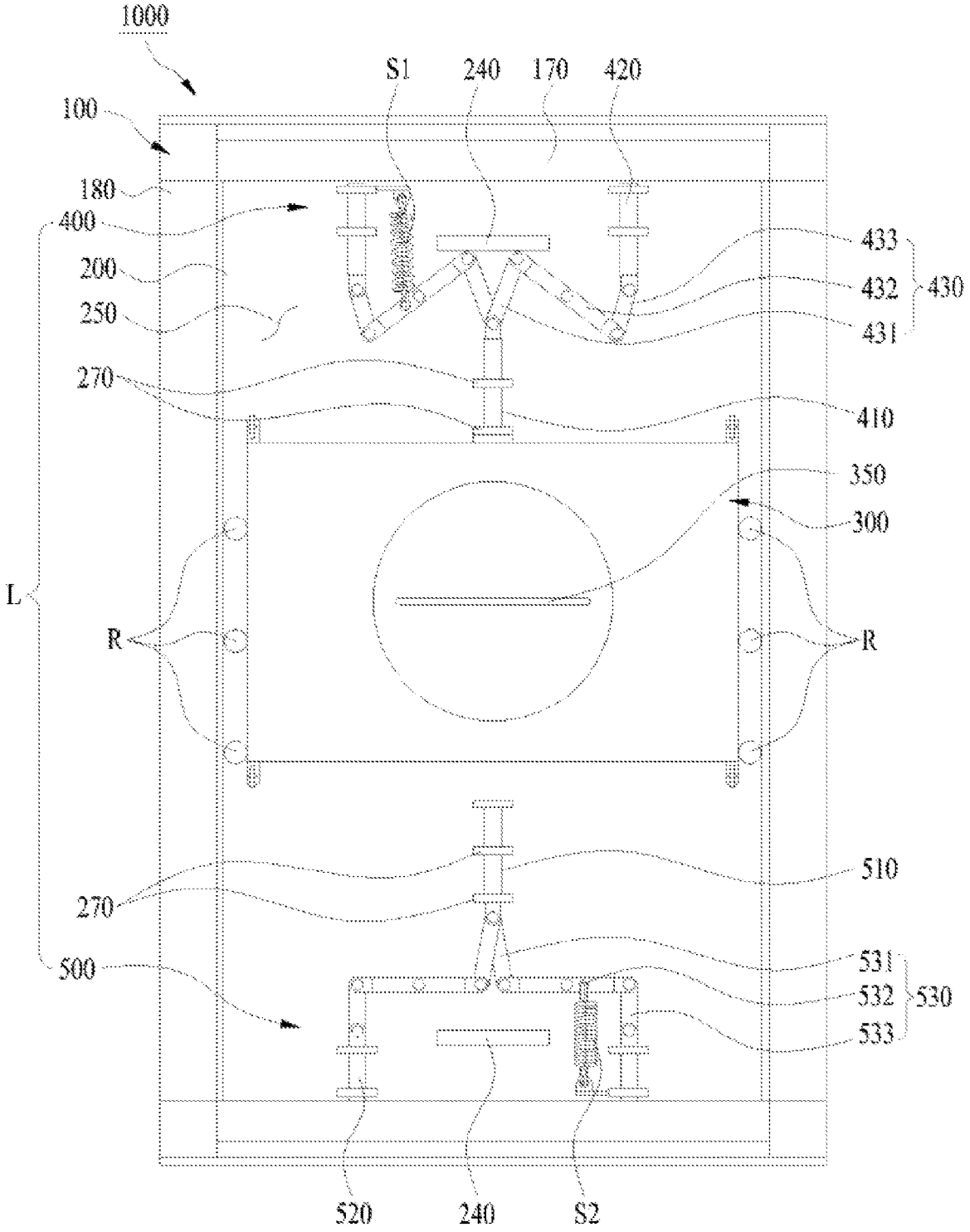
FIG. 4 is a front view illustrating an example emergency escape apparatus of ship configured to be opened by buoyancy.
Figure 6:
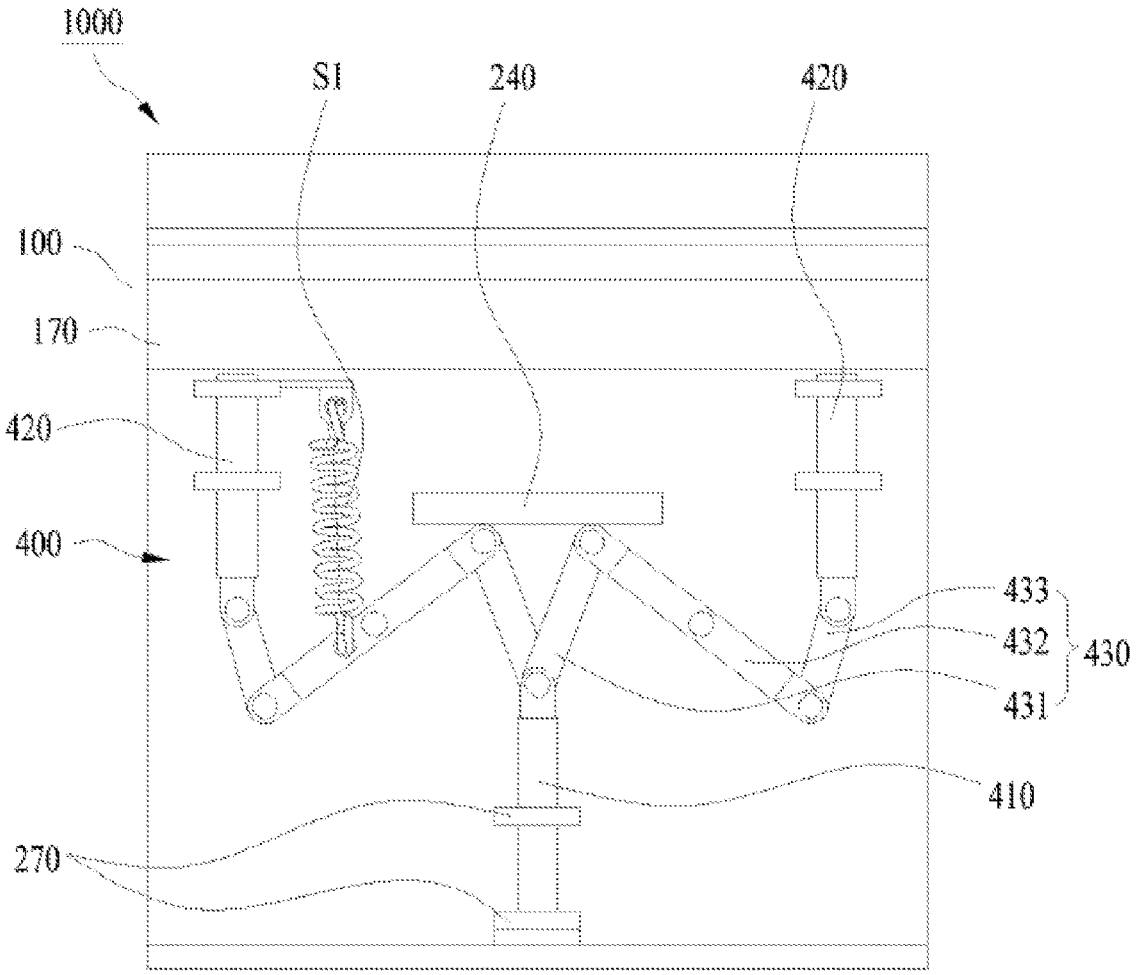
FIG. 6 is an enlarged view of front view illustrating example parts of an emergency escape apparatus of ship configured to be opened by buoyancy based on decoupling an example escape door.

As shown in FIGS. 4 and 6, when a ship is flooded or when water flows in and comes in contact with floater 300, the floater 300 may ascend by buoyancy.

The floater 300 may press, in an upward direction, the first pushing rod 410 which is located at an upper side of the floater 300.

The first pushing links 431, which are branched from the first pushing rod 410 in left and right sides of the first pushing rod 410 and configured to hingedly move about the first pushing rod 410, may move upward to cause the pair of first connection links 432 to rotate about the hinge point P in opposite directions to each other. For example, one of the pair of connection links 432 may rotate in a clockwise direction about a first hinge point, and the other of the pair of connection links 432 may rotate in a counterclockwise direction about a second hinge point based on the first pushing links 431 moving together in the upward direction.

Each of the first hinge point and the second hinge point may be located between ends of each one of the pair of connection links 432.

The first latching rods 420 may be released from the latching groove 120 of the latching part 170 based on a downward movement of an outer side of each of the pair of the first connection link 432.

Figure 7:
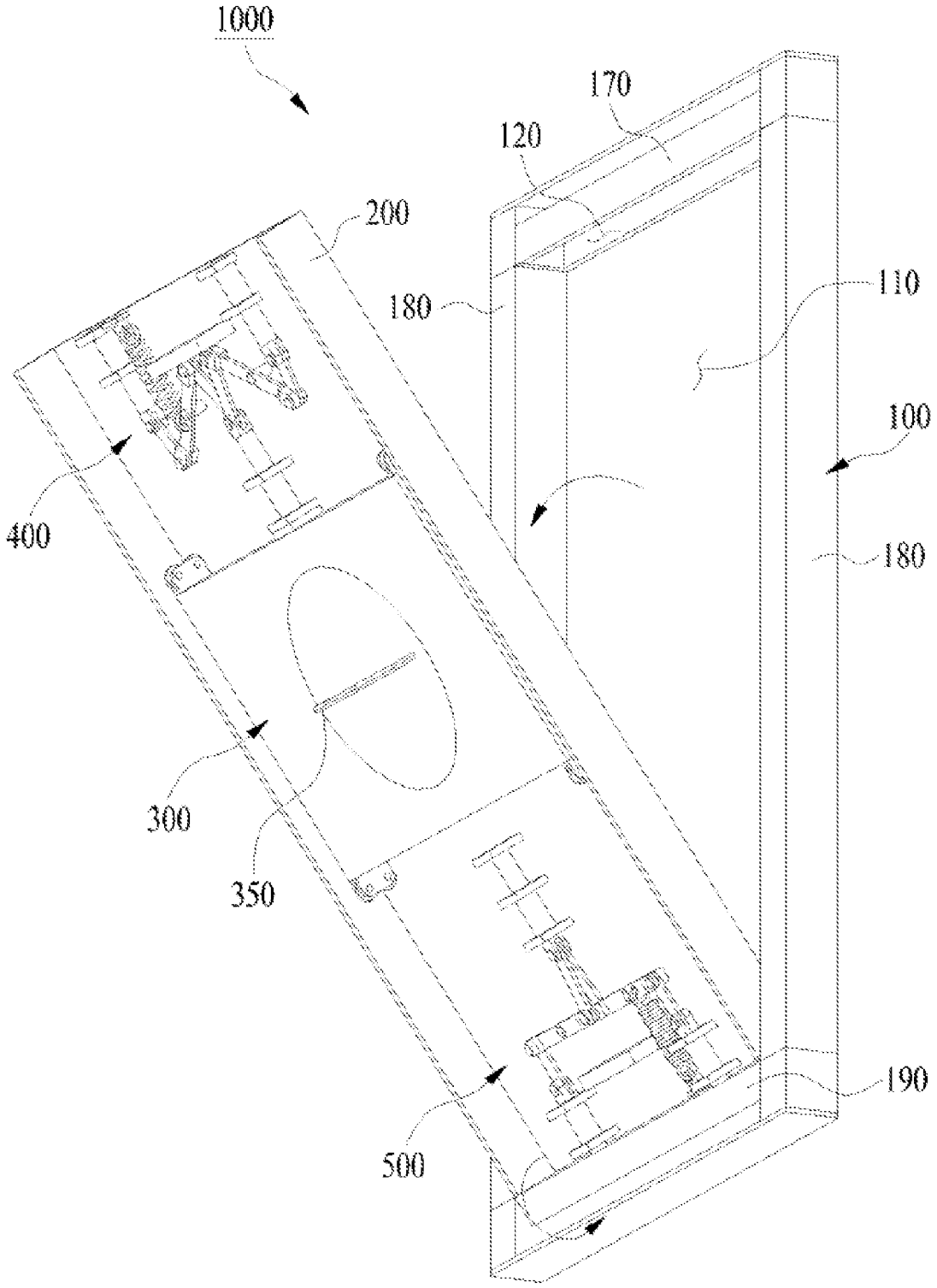
FIG. 7 is a side view illustrating an example emergency escape apparatus of ship in a state of an example escape door being opened.

As a result, the escape door 200 may be separated from the support frame 100, as shown in FIG. 7, and when the escape door 200 is pushed with respect to the support frame 100 from the cabin, in a state in which the second latching rod 520 of the escape door 200 is inserted in the latching groove 120 on the lower latching part 190 of the support frame 100, the escape door 200 may hingedly move relative to the side 180 of the support frame 100 to that the emergency escape apparatus 1000 may be opened.

Through the exit opening 110 of the support frame 100, the passengers may quickly escape from the ship.

In some examples, the escape door 200 may be re-installed to the support frame 100 by lifting the escape door 200 to its original position, in which the latching part 190 of the support frame 100 counter-turns with respect to the side 180 of the support frame 100. In some cases, the side 180 of the support frame 100 may include a spring that facilitates reinstallation of the escape door 200.

The above-described implementations of the present disclosure are merely illustrative, but for those with technical background in the art, the aforementioned scope of claims can vary in form and details depending on other exemplified fields applied.

What is claimed is:

1. An escape apparatus for a vessel, the escape apparatus comprising:

a support frame configured to be installed at the vessel, the support frame defining an exit opening;

an escape door located at an inner side of the exit opening and configured to open and close the exit opening, the escape door defining an accommodation space;

a floater located in the accommodation space of the escape door and configured to be raised relative to the support frame; and an unlocking device configured to, based on being pushed by the raised floater, release coupling between the escape door and the support frame, wherein the unlocking device comprises a first unlocking part located at an upper side of the floater, and wherein the first unlocking part comprises:

a first pushing rod that extends in an upward direction from the upper side of the floater and that is configured to move upward based on being pushed by the upper side of the floater, a first latching rod configured to move downward to be released from the support frame based on the first pushing rod moving upward, a first link assembly that connects the first pushing rod and the first latching rod to each other, and a first spring that connects the escape door and the first link assembly to each other.

2. The escape apparatus of claim 1, wherein the unlocking device further comprises a second unlocking part located at a lower side of the floater, and wherein the second unlocking part comprises:

a second pushing rod that extends in a downward direction from the lower side of the floater and that is configured to move downward based on being pushed by the lower side of the floater;

a second latching rod configured to move upward to be released from the support frame based on the second pushing rod moving downward;

a second link assembly that connects the second pushing rod and the second latching rod to each other; and a second spring that connects the escape door and the second link assembly to each other.

3. The escape apparatus of claim 2, wherein the first latching rod comprises a pair of first latching rods that are located at a first lateral side and a second lateral side with respect to the first pushing rod, respectively, the pair of first latching rods being configured to move downward together based on the first pushing rod moving upward, and wherein the second latching rod comprises a pair of second latching rods that are located at the first lateral side of the second pushing rod and the second lateral side with respect to the second pushing rod, the pair of second latching rods being configured to move upward together based on the second pushing rod moving downward.

4. The escape apparatus of claim 3, wherein the first link assembly comprises:

a pair of first pushing links, each of the pair of first pushing links having a first end connected to an upper end of the first pushing rod;

a pair of first connection links, each of the pair of first connection links being configured to rotate about a first hinge axis positioned at a rear cover of the escape door, and having a first end connected to a second end of one of the pair of first pushing links; and a pair of first latching links, each of the pair of first latching links having a first end connected to the first end of one of the pair of first connection links, and a second end connected to a lower end of one of the pair of first latching rods, and wherein the second link assembly comprises:

a pair of second pushing links, each of the pair of second pushing links having a first end connected to a lower end of the second pushing rod, a pair of second connection links, each of the pair of second connection links being configured to rotate about a second hinge axis positioned at the rear cover of the escape door, and having a first end connected to a second end of one of the pair of second pushing links, and a pair of second latching links, each of the pair of second latching links having a first end connected to the first end of one of the pair of second connection links, and a second end connected to an upper end of one of the pair of second latching rods.

5. The escape apparatus of claim 4, further comprising a guide bracket that is located at the rear cover of the escape door and that defines a guide hole configured to guide movement of at least one of the first pushing rod, the second pushing rod, the first latching rod, or the second latching rod.

6. The escape apparatus of claim 5, wherein the guide bracket comprises a plurality of guide brackets coupled to the first spring and to the second spring, respectively.

7. The escape apparatus of claim 2, wherein the escape door comprises a front cover that is configured to face an interior of the vessel and a rear cover that is configured to face an outside of the vessel and that is coupled to the front cover, wherein the accommodation space is defined between the front cover and the rear cover, and wherein at least one of the front cover or the rear cover defines an opening that allows water to enter the accommodation space.

8. The escape apparatus of claim 7, wherein the upper side of the floater is configured to contact a lower end of the first pushing rod based on the floater moving upward by buoyancy of the floater.

9. The escape apparatus of claim 7, wherein the rear cover comprises at least one protrusion that extends from an inner surface of the rear cover toward the front cover and that is configured to limit deformation of the front cover toward the rear cover.

10. The escape apparatus of claim 9, wherein the first link assembly is configured to contact the protrusion based on the first pushing rod moving upward by the upper side of the floater.

11. The escape apparatus of claim 2, wherein the floater is located vertically between a lower end of the first pushing rod and an upper end of the second pushing rod.

12. The escape apparatus of claim 1, wherein the escape door comprises a front cover that is configured to face an interior of the vessel, the front cover comprising a handle located at a front surface of the front cover and an access part that allows a user to access the handle to operate the floater.

13. The escape apparatus of claim 12, wherein the access part is configured to cover the handle from the interior of the vessel, and wherein the floater is configured to be raised based on the user passing through the access part and lifting the handle relative to the support frame.

14. The escape apparatus of claim 1, wherein the escape door defines an opening that is positioned at at least one of a lower portion of the escape door or an upper portion of the escape door, that communicates with the accommodation space, and that allows water to enter the accommodation space, and wherein the floater is configured to be raised in the accommodation space by buoyancy of the floater in water.

15. An escape apparatus for a vessel, the escape apparatus comprising:

a support frame configured to be installed at the vessel, the support frame defining an exit opening;

an escape door located at an inner side of the exit opening and configured to open and close the exit opening, the escape door defining an accommodation space;

a floater located in the accommodation space of the escape door and configured to be raised relative to the support frame;

an unlocking device configured to, based on being pushed by the raised floater, release coupling between the escape door and the support frame; and a plurality of guide rollers that are located in the accommodation space at a position between an outer surface of the floater and an inner surface of the escape door facing the outer surface of the floater, the plurality of guide rollers being configured to guide movement of the floater toward at least one of an upper side of the support frame or a lower side of the support frame.

* * * * *